United States Patent [19]

Giebel

[11] 4,040,559

[45] Aug. 9, 1977

[54] CARTON WITH SMOOTH REINFORCED HAND HOLE

[75] Inventor: Buddy E. Giebel, Monroe, Mich.

[73] Assignee: Union Camp Corporation, Wayne, N.J.

[21] Appl. No.: 741,683

[22] Filed: Nov. 15, 1976

[51] Int. Cl.[2] ..... B65D 13/00; B65D 5/46

[52] U.S. Cl. ..... 229/23 R; 229/44 R; 229/45 R; 206/424; 229/52 B

[58] Field of Search ..... 229/23 R, 44 R, 45, 229/52 B; 206/424

[56] References Cited

U.S. PATENT DOCUMENTS

| | | | |
|---|---|---|---|
| 2,483,174 | 9/1949 | Belsinger | 229/44 R X |
| 2,548,130 | 4/1951 | Stephan | 229/45 X |
| 2,612,305 | 9/1952 | Klasing et al. | 229/44 R X |
| 2,823,846 | 2/1958 | George | 229/44 R X |
| 2,990,999 | 7/1961 | George et al. | 220/44 R |
| 3,095,137 | 6/1963 | Reynolds | 229/44 R |
| 3,348,758 | 10/1967 | Bllis | 229/44 R |
| 3,927,822 | 12/1975 | Giebel | 229/23 R |

*Primary Examiner*—Davis T. Moorhead

*Attorney, Agent, or Firm*—Kane, Dalsimer, Kane, Sullivan and Kurucz

[57] ABSTRACT

An end wall for a Bliss-type carton having a full height outer panel, cut out to provide a hand-hole flap hinged along a top score line and reverse folded, and inner and intermediate shorter panels, all of the panels being interconnected along score lines, the inner and intermediate panels having a cut out therebetween to provide a projecting portion and a recess, the inner and intermediate panels being reverse folded above the hand-hole and secured to the outer panel with the projecting portion overlying the hand-hole flap and the flap within the recess, thereby providing a smooth hand-hole and a reinforced area above the hand-hole.

4 Claims, 9 Drawing Figures

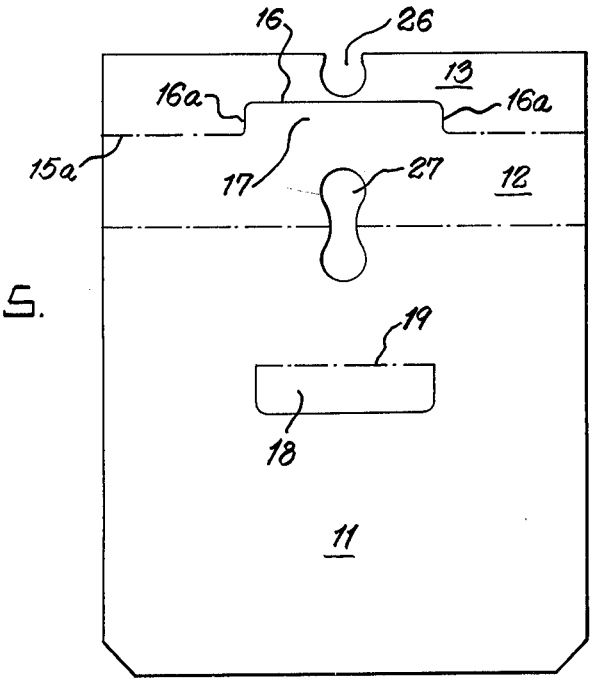
Fig. 5.
Fig. 6.
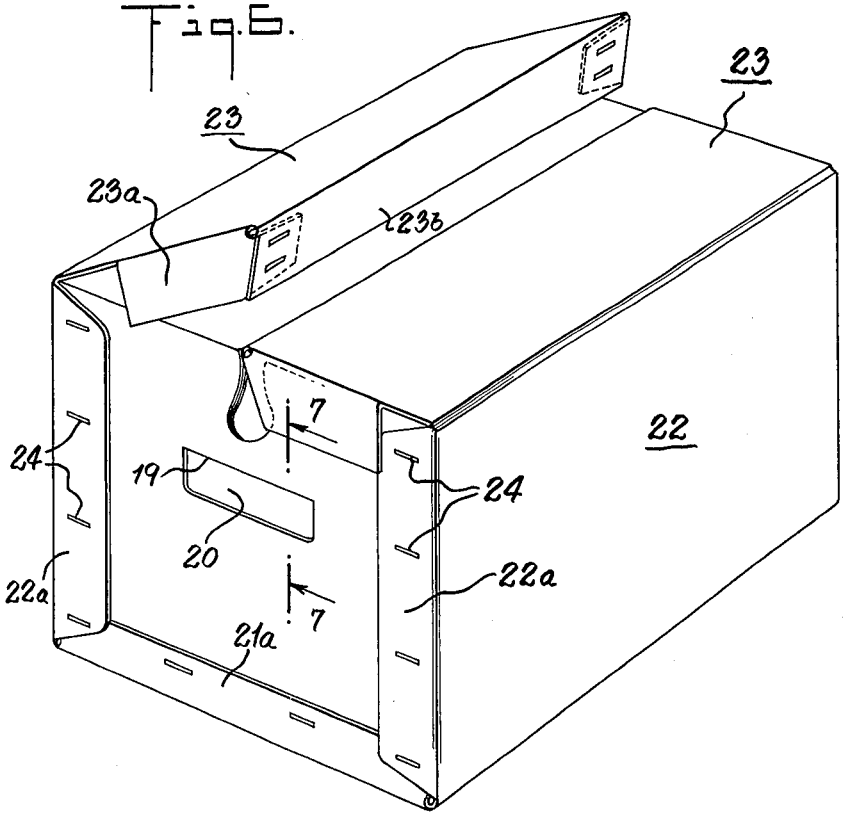
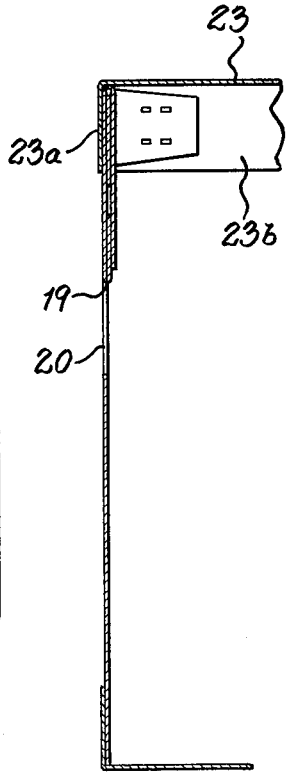
Fig. 7.

CARTON WITH SMOOTH REINFORCED HAND HOLE

BACKGROUND OF THE INVENTION

This invention relates to an improvement in cartons, and more particularly to the end walls of a carton, such as a Bliss-type carton, suitable for bottles and other heavy products which require protection in shipment and for reuse. In conventional cartons of this type the end walls are usually formed from two or three panels hinged together, with aligned hand-holes completely cut out of all the panels. In some cases a strip of paperboard or wood is inserted above the hand-hole to serve as a reinforcement.

In the end wall of the present invention two extra panels connected to the outer panel provided with a hand-hole are cut out to provide a projecting portion and a recess which permits the panels to be superimposed and secured together with the projecting portion overlying the reverse folded hand-hole flap and the flap within the recess, thus providing a smooth hand-hole and a reinforced area above the hand-hole with no bulging of the superimposed three layers and with a minimum of board.

SUMMARY OF THE INVENTION

It is an object of the present invention to provide an end wall for a hand-hole carton having the panels thereof so cut out and folded to provide a smooth hand-hole and a reinforced area above the hand-hole.

It is a further object to provide a carton embodying the end walls of the present invention wherein the construction provides a reinforced area above the hand-hole with a minimum amount of board in cartons particularly adapted for beer and beverage bottles.

It is a further object to provide a blank for an end wall of a hand-hole carton which is simple and economical to manufacture and can be easily set up to provide an end wall which is efficient and well suited for its intended purpose.

BRIEF DESCRIPTION OF THE DRAWINGS

Other objects and advantages will become apparent from the following description which is to be taken in conjunction with the accompanying drawings, in which:

FIG. 5 is a plan view of a modified blank for forming an end wall for a Bliss-type carton with cover slots in the end walls.

FIG. 6 is a perspective view of a carton formed from the blank of FIG. 5; and FIG. 7 is a cross-sectional view along the line 7—7 of FIG. 6.

DESCRIPTION OF THE PREFERRED EMBODIMENT

Figure 1:
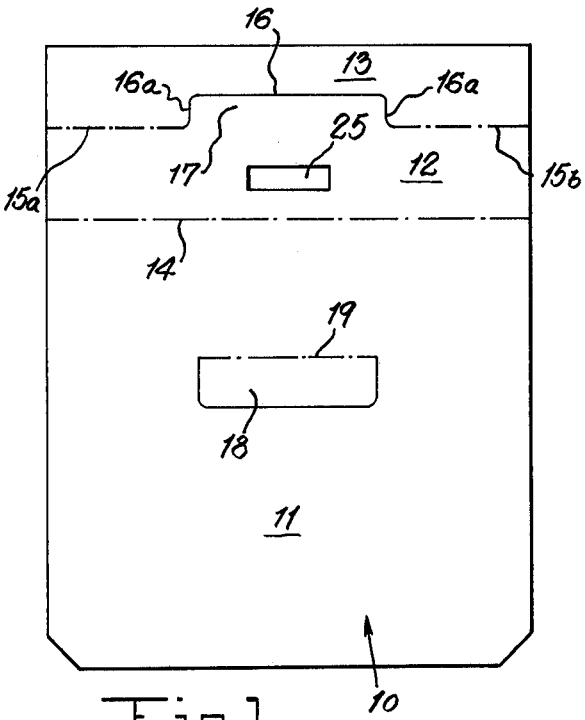
FIG. 1 is a plan view of a blank for forming an end wall for a Bliss-type carton, the said end wall embodying the present invention.

Referring to the drawings, there is shown in FIG. 1 a generally rectangular blank 10 of sheet material, such as fiberboard or the like, of a weight suitable for the type of carton to be constructed. The blank consists of three panels which can be folded to form the end wall of a Bliss-type carton, namely outer panel 11, inner panel 12 and intermediate panel 13. Panels 11 and 12 are attached along a straight score line 14. Panels 12 and 13 are attached along cut hinge score lines **15*a* and 15*b* spaced apart and in line with each other. Between the hinge score lines 15*a* and 15*b* is U-shaped cut with a straight line cut 16 and curved end cuts 16*a*, the outer ends of the curved end cuts running to the inner ends of the hinge score lines 15*a* and 15*b*. Such cuts define a projecting portion 17.**

Figure 2A:
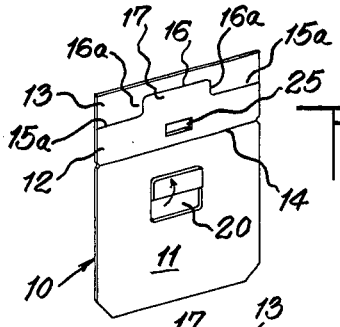
FIGS. 2A, 2B and 2C are perspective views of the blank of FIG. 1 showing the folding of the panels and hand-hole flap to form the end wall of the present invention.
Figure 2B:
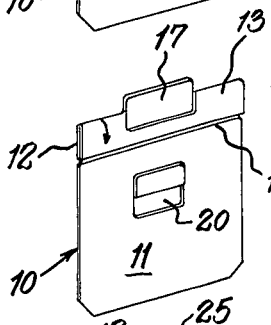
Figure 2C:
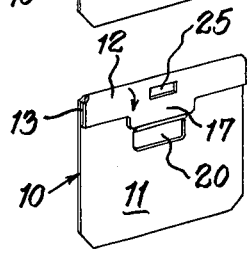

Panel 11 is provided with a rectangular hand-hole flap 18 cut out of the panel 11 on three sides and connected thereto on the fourth side along a score line 19 which serves as a hinge. When the flap 18 is reverse folded along the hinge line 19 and secured by adhesive or other means to the panel 11 (FIG. 2), there remains a hand-hole 20.

The hinge score lines **15*a* and 15*b* are so positioned that the intermediate panel 13 when reverse folded along such score lines will extend substantially to the score line 14 between panels 11 and 12. The projecting portion 17 is so cut out and positioned that the bottom edge of such projecting portion will extend substantially to the top of the hand-hole 20 in panel 11. Furthermore the projecting portion is large enough so that when the three panels are superimposed, the recess 21 in the intermediate panel 13 formed by the projecting portion cutout is wide and deep enough that it will receive the hand-hole flap 18 above the hand-hole 20.**

In forming the end wall (FIGS. 2A, 2B and 2C) the hand-hole flap 18 is reverse folded along the score line 19 and secured preferably by adhesive to the outer panel 11 above the hand-hole 20. The intermediate panel 13 is reverse folded along the hinge score lines **15*a* and 15*b* and secured likewise, by adhesive, to the inner panel 12. The superimposed panels 12 and 13 are reverse folded along the score line 14 and secured likwise by adhesive to the outer panel 11. Because of the size of the U-shaped cut which forms the projecting portion 17. The hand-hole flap 18 will fit into the recess under the projecting portion 17.** Thus all the superimposed panels, the hand-hole flap and projecting portion will form only three layers of board above the hand-hole with no bulging. Furthermore, the top of the hand-hole will be smooth for gripping and lifting the carton and the area above the hand-hole will have a three layer reinforced area over the entire portion above the hand-hole for maximum strength. Such construction is accomplished with a minimum amount of board.

Figure 3:
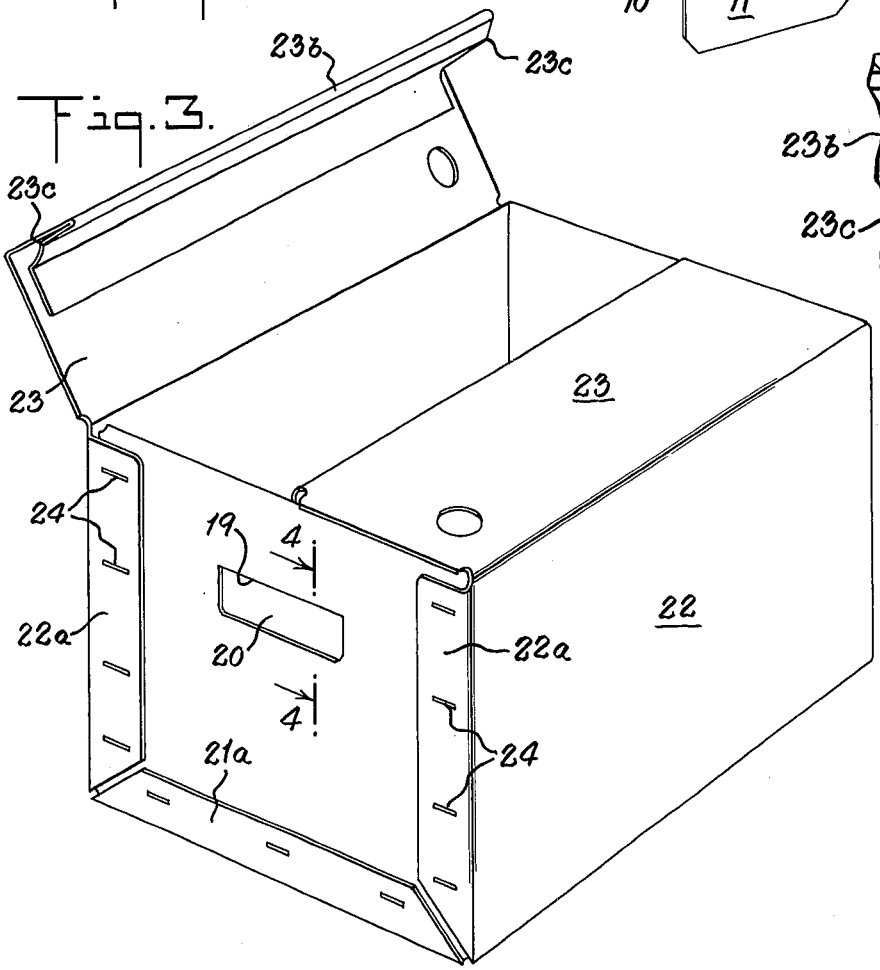
FIG. 3 is a perspective view of a carton formed from the blank of FIG. 1.
Figure 4:
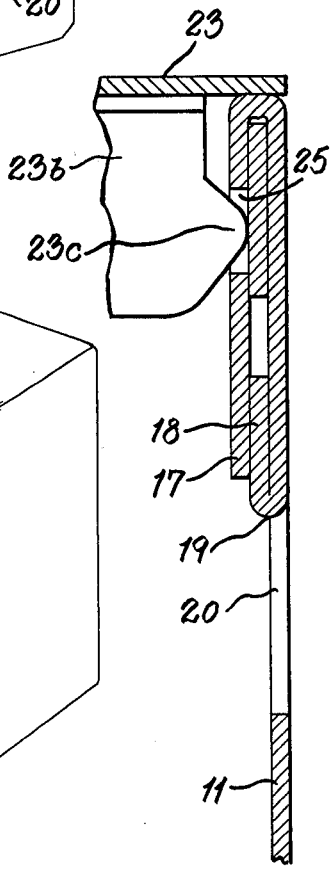
FIG. 4 is a cross-sectional view along the line 4—4 of FIG. 3.

In assembling the carton with the folded end walls having two panels as heretofore described, a sheet, scored to form a bottom 21, side walls 22 and cover flaps 23 and flanges **21*a* and 22*a*, is secured to such end walls by stitching 24 the bottom and side flanges 21*a* and 22*a* to the bottoms and sides of the end walls (FIG. 3). As shown in FIG. 3 the cover flaps 23 are provided with inner flanges 23*b* but no end flanges. Such flanges 23*b* fit within the end walls with only the ends of the flaps resting on the tops of the end walls. If desired, the inner panels of the end walls can be provided with locking slots 25 and the ends of the cover flanges 23***b* can be provided with raised tips 23*c* to slip into the slots 25 to hold the cover flaps in closed position.

The modified blank shown in FIG. 5 is the same as that shown in FIG. 1 except that it is provided with matching locking slots 26 and 27 which will likewise be superimposed when the panels are folded to form the end wall (FIG. 6). In such case the cover flaps 23 are provided with end flanges 23*a* connected at the corners to the inner flanges 23*b*. The inner flanges 23*b* will butt, the end flanges 23*a* will extend over the end walls, and the corners joining such flanges will fit into the slots (FIG. 6). The locking means described herein may be varied and does not form any part of the present invention except in so far as it is fitted into the reinforced area above the hand-hole. The construction of the present invention provides a reinforced area between the top of the hand-hole and the locking slot. The weakness in this area has been of some concern for breweries and other bottlers who ship in paperboard cartons. Thus the present invention gives a double improvement for cartons of this type.

Thus among others, the several aforenoted objects and advantages are most effectively attained. Although a somewhat preferred embodiment of the invention has been disclosed and described in detail herein, it should be understood that this invention is in no sense limited thereby and its scope is to be determined by that of the appended claims.

Having thus described the invention, what is claimed is:

1. In a Bliss-type carton of paperboard having the bottom and side walls secured to individual end walls the improvement in each end wall comprising:

a full height outer panel;

a hand hole cut out of the outer panel to provide a hand hole flap hinged along a top score line and reverse folded and secured to the inner surface of the outer panel;

an inner panel connected to the top of the outer panel along a first score line; and an intermediate panel connected to the inner panel along end score lines spaced apart and in line with each other;

the inner and intermediate panels each having a height no greater than the distance between the top of the hand hole and the top of the outer panel;

a U-shaped cut out between the spaced end score lines formed by a straight line cut and end cuts, the outer ends of the end cuts running to the inner ends of the spaced end score lines to provide a recess in the intermediate panel and a projection from the inner panel;

the inner and intermediate panels being reverse folded above the hand hole and secured to the outer panel with the projection overlying and secured to the hand hole flap and the hand hole flap within the recess;

thereby providing a smooth hand hole and a triple layer reinforced area above the hand hole.

2. The carton of claim 1 in which the carton has cover flaps hinged to the side walls, the said cover flaps having flanges, and each end wall having locking slots cut into the panels to receive the said cover flaps, the projection and hand hole flap providing a reinforcement between the hand hole and the locking slot.

3. The carton of claim 1 in which the carton has cover flaps hinged to the side walls, the said cover flaps having longitudinal flanges with tips at the ends of each flange, and slots cut into the inner panels to receive the said tips and hold the cover flaps in closed position.

4. A one sheet blank made from a generally rectangular sheet of paperboard having three connected panels adapted to be folded into an end wall for a Bliss-type carton in which the bottom and side walls are secured to two individual end walls comprising:

a full height outer panel;

a hand hole cut out of the outer panel to provide a hand hole flap hinged along a top score line and adapted to be reverse folded and secured to the inner surface of the outer panel;

an inner panel connected to the top of the outer panel along a first score line; and an intermediate panel connected to the inner panel along end score lines spaced apart and in line with each other;

the inner and intermediate panels each having a height no greater than the distance between the top of the hand hole and the top of the outer panel;

a U-shaped cut out between the spaced end score lines formed by a straight line cut and end cuts, the outer ends of the end cuts running to the inner ends of the spaced end score lines to provide a recess in the intermediate panel and a projection from the inner panel;

whereby, when the inner and intermediate panels are reverse folded above the hand hole and secured to the outer panel, the U-shaped cut out provides a projection from the inner panel adapted to overlie the hand hole flap and be secured thereto and a recess adapted to receive the said hand hole flap;

thereby providing a smooth hand hole and a triple layer reinforced area above the hand hole.

* * * * *